United States Patent [19]

Boast

[11] 4,190,295

[45] Feb. 26, 1980

[54] MINING MACHINES WITH CUTTER CHAIN TENSIONING MEANS

[75] Inventor: Gordon E. Boast, Burton-on-Trent, England

[73] Assignee: Coal Industry (patents) Limited, London, England

[21] Appl. No.: 857,455

[22] Filed: Dec. 5, 1977

[30] Foreign Application Priority Data

Dec. 21, 1976 [GB] United Kingdom ..... 53244/76

[51] Int. Cl.[2] ..... E21C 25/56

[52] U.S. Cl. ..... 299/43; 299/61; 299/80; 305/32

[58] Field of Search ..... 299/34, 42, 43, 61, 299/80; 74/242.8, 245 C; 305/16, 31, 32

[56] References Cited

U.S. PATENT DOCUMENTS 3,658,385 4/1972 Oven et al. ..... 299/43

3,790,210 2/1974 Georg ..... 299/43

4,037,876 7/1977 Georg et al. ..... 299/43

*Primary Examiner*—James A. Leppink

*Assistant Examiner*—Nick A. Nichols, Jr.

*Attorney, Agent, or Firm*—Stevens, Davis, Miller & Mosher

[57] ABSTRACT

A mineral mining machine suitable for working short-wall faces is provided with a pivotted cutter member including a guideway for a cutter chain carrying picks and paddle devices for scooping debris. The guideway is divided at or about its mid point into two parts which are interconnected by guide means and actuating rams. The guide means are in the form of bars slidably engaged by runners attached to the guideway. Operation of the actuating means can effect tensioning of the cutter chain. The base of the machine has two interchangeable sections facilitating a change of hand when this is desired, the disposition of the chain tensioning arrangement in the middle of the guideway being of advantage in this connection.

7 Claims, 3 Drawing Figures

MINING MACHINES WITH CUTTER CHAIN TENSIONING MEANS

This invention concerns improvements in and relating to a mineral mining machine particularly of the type described and claimed in the assignees United Kingdom Patent Specification No. 1 229 238.

In the above-numbered patent specification there is claimed a mineral mining machine (hereinafter referred to as the type described) comprising a conveying track for cut mineral extending transversely to the direction of advance of the machine and disposed adjacent to a floor on which the machine is supported for advance over, a cutter member supported for vertical movement as a whole, the member including a guideway having upper and lower runs extending generally parallel to the conveying track and adapted to support an endless cutter chain, and a drive motor for the cutter chain mounted on the member.

There is also in U.K. Patent Specification No. 1 229 238, a reference to the retensioning of the cutter chain, and on this particular type of mineral mining machine a tensioning assembly was provided adjacent one end of the drive member, the drive sprocket for the chain and the motor driving it being mounted on a base plate movable relative to the remainder of the frame. It is usual to mount a mineral mining machine of the type described on a base and to provide on the base a material discharge section to which, in use, a loading-out conveyor may conveniently be associated, a chute being located on the drive member for directing cut material to the discharge section. The discharge section is located remote from the tensioning assembly, adjacent one end of the machine. When it was required to locate the loading out conveyor at the other end of the machine as is sometimes required, it was necessary to reposition the material discharge section and the chute accordingly. However, the disposition of the chain tensioning assembly precluded the repositioning of the chute with the consequence that the drive member as a whole had to be completely turned round such that the tensioning assembly is now at the other end of the machine. Thus in order to change the machine from one hand to the other as far as loading-out is concerned is a laborious and time-consuming task.

An object of the present invention is therefore to provide a machine of the type described which obviates the above difficulties.

According to the invention, there is provided a mineral mining machine of the type described in which the guideway of the cutter member is in at least two parts movable relatively with respect to one another on guide means provided therefor, and fluid operable means interconnecting the two parts of the guideway and actuable to effect such relative movement.

The guideway of the cutter member may be divided at or adjacent a central portion thereof to form the two parts or may be divided at any location along the length of the guideway except at each end thereof.

The guide means may conveniently include cylindrical rods which are slidably engaged by runners on each part of the guideway, and which may be provided adjacent the upper and lower runs. A bridge member may interconnect the runners associated with the guide means on each part of the guideway, the fluid operable means being disposed between the bridge members and in abutting relationship thereto. The fluid operable means may be in the form of a ram either hydraulically as a preference, or pneumatically operable.

By way of example only, one embodiment of mineral mining machine according to the invention is described below with reference to the accompanying drawing in which.

Figure 1:
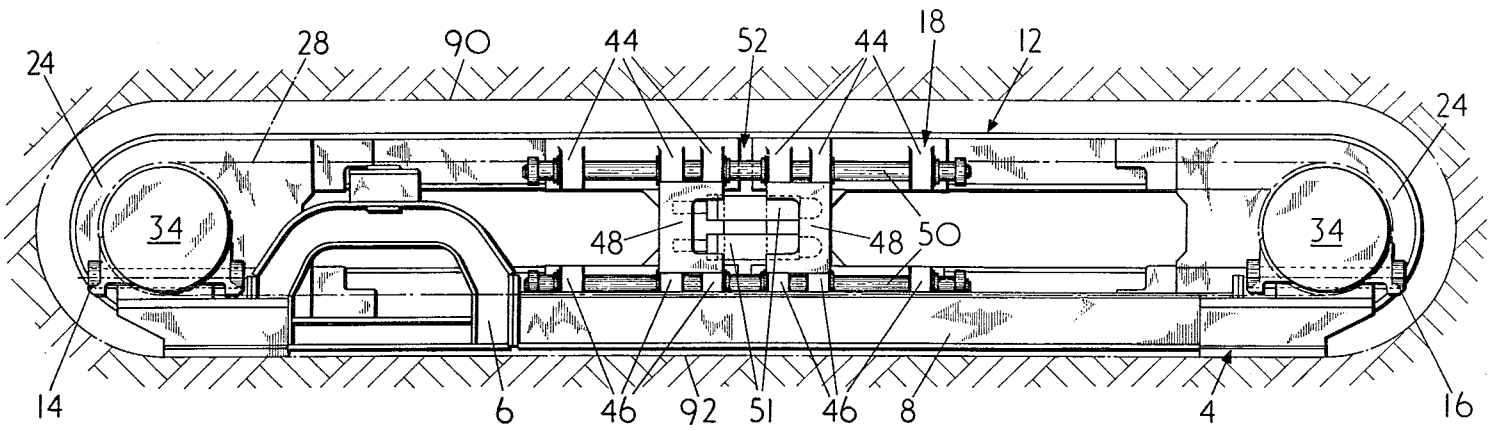
FIG. 1 is a rear side elevation of the machine.
Figure 2:
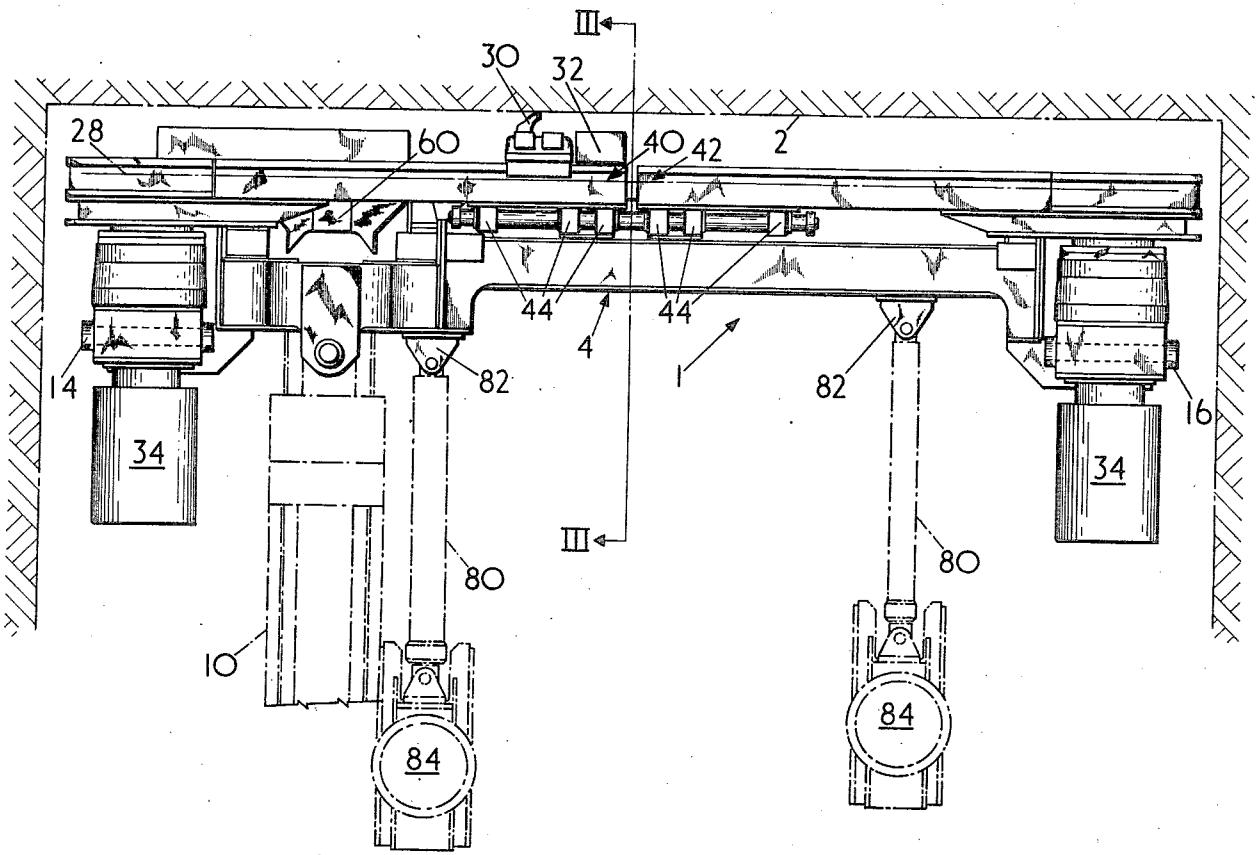
FIG. 2 is a plan view of the machine as shown in FIG. 1.
Figure 3:
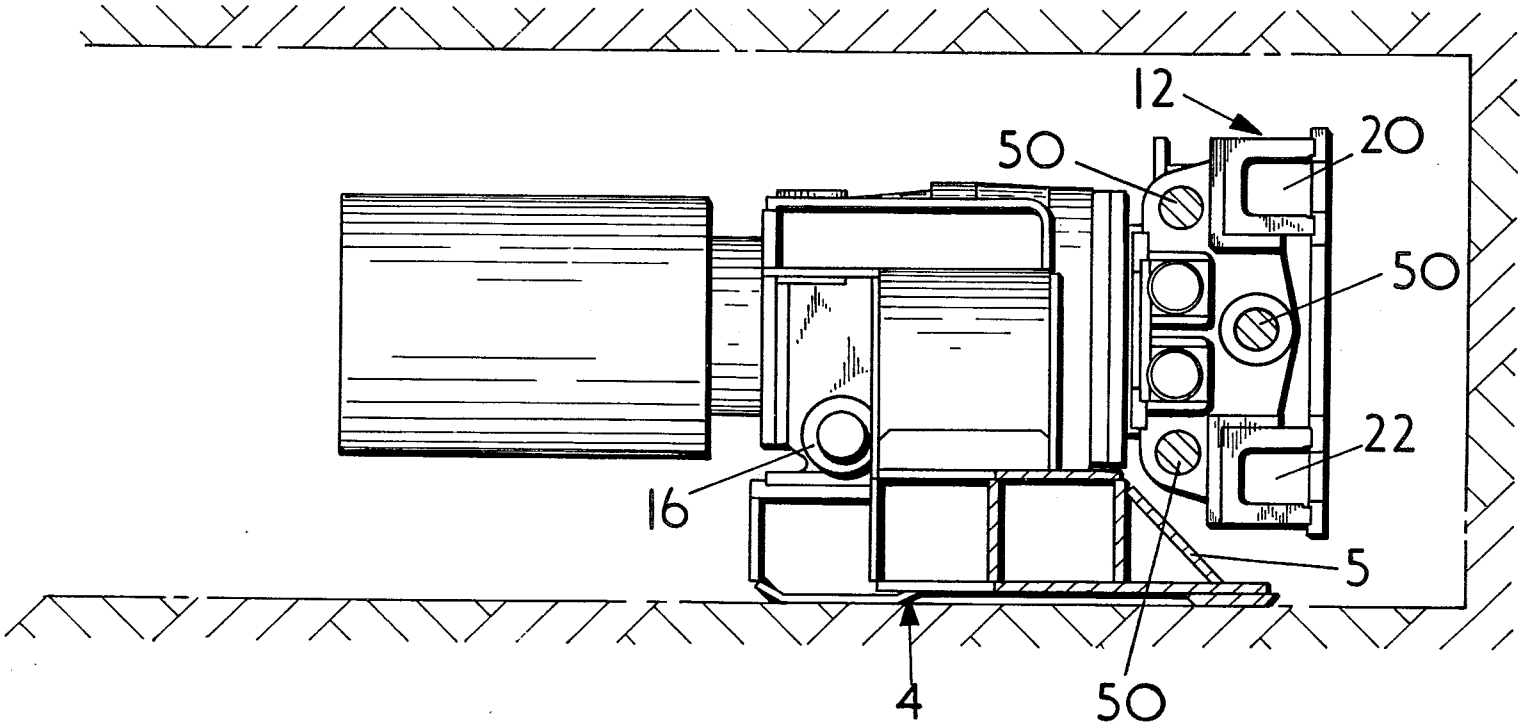
FIG. 3 is a sectional end elevation on the line III—III in FIG. 2.

Referring to FIGS. 1, 2 and 3 of the drawing, a mineral mining machine 1 is depicted as excavating mineral to advance a shortwall face 2. The machine 1 includes a base shown generally at 4, which includes a material discharge section 6 and a beam section 8, the section 6 being cooperable with a loading-out conveyor 10 (shown in ghosted outline in FIG. 2). The base 4 also includes a conveying track in the form of a ramp plate 5. A rigid cutter member 12 is pivotally supported at 14, 16 to the base 4 and comprises a guideway 18 having upper and lower runs 20, 22 respectively and curved end portions 14. Pivotal movement of the cutter member 12 relative to the base 4 is effected by rams (not shown) which act between the base 4 and the cutter member 12. An endless mineral cutter chain indicated by line 28 carries a plurality of cutter tools 30 and of loading flights 32, only one of each of which is shown in FIG. 2, the chain 28 being driven by electric motors 34 one located at each end of the machine 2 as shown.

The guideway 18 is formed in two parts 40, 42 movable relatively with respect to one another longitudinally with respect to the base 4. Runners 44, 46 are provided on each part adjacent the upper and lower runs 20, 22 respectively, a bridge member 48 interconnecting those runners 44, 46 located adjacent the free ends of each part 40, 42. The runners 44, 46 on each part 40, 42 slidably engage around guide rods 50 which freely extend across the gap 52 between the two parts of the guideway 18. A pair of hydraulic double-acting rams 51 also extends across the gap 52 and each is pivotally connected at each of its ends to a bridge member 48. When tensioning of the chain 28 is required, the rams 51 are pressurized to extend to move the two parts 40, 42, and thus the upper and lower runs 20, 22, further apart. The parts 40, 42 are then conveniently locked in their new position either hydraulically or mechanically.

If it is desired to change the hand of the machine 1 as far as the disposition of the conveyor 10 is concerned, the discharge section 6 and the beam section 8 of the base 4 are changed around such that the section 6 lies on the right hand side of the machine as viewed in FIG. 1. In addition, a material discharge chute 60 is also repositioned on the guideway 18 such as to align with the section 6. Since the chain tensioning arrangement constituted by the rams 51, guide rods 50, and runners 44, 46 is located away from the ends of the cutter member 12, the change of hand of the machine 1 is facilitated.

The machine 1 also includes advancing rams 80 which are connected at 82 to the base 4 (FIG. 2) and staked by props 84, actuation of the rams 80 to extend them when the props 84 are staked between the roof 90 and the floor 92 causes advancement of the machine 1.

It is to be understood that while the specific example of the mineral mining machine depicts only three guide rods 50, it is within the scope of this invention to provide a smaller or a greater number thereof, for example only two, or four.

I claim:

1. A mineral mining machine comprising a conveying track for cut mineral extending transversely to the direction of advance of the machine and disposed adjacent to a floor on which the machine is supported for advance over, a cutter member supported for vertical movement as a whole, the member including a guideway, the guideway having upper and lower runs extending generally parallel to the conveying track, an endless cutter chain supported by the upper and lower runs of the guideway, and a drive motor for the drive chain mounted on the member, wherein the invention comprises the guideway of the cutter member being divided centrally into two halves movable relatively with respect to one another, guide means on which the two halves are relatively movable, and fluid operable means interconnecting the halves of the guideway and actuable to effect the relative movement.

2. A machine according to claim 1 in which the fluid operable means is in the form of at least one ram.

3. A machine according to claim 1 in which the guide means include cylindrical rods, and runners are provided on each part of the guideway, the runners slidably engaging the rods.

4. A machine according to claim 3 in which the runners are provided adjacent the upper and lower runs of the guideway.

5. A machine according to claim 4 in which a bridge member interconnects the runners associated with the guide means on each part of the guideway, the fluid operable means being disposed between the bridge members and in abutting relationship thereto.

6. A machine according to claim 1 including a base comprising a material discharge section and a beam section.

7. A machine according to claim 6 in which the material discharge section and the beam section include means for positional interchange.

* * * * *